US005199880A

United States Patent [19]

Arai

[11] Patent Number: 5,199,880

[45] Date of Patent: Apr. 6, 1993

[54] MULTIPOLE ELECTRICAL CONNECTOR

[75] Inventor: Tatsuya Arai, Tokyo, Japan

[73] Assignee: Hirose Electric Co., Ltd., Tokyo, Japan

[21] Appl. No.: 753,379

[22] Filed: Aug. 30, 1991

[30] Foreign Application Priority Data

Sep. 17, 1990 [JP] Japan ..... 2-96511[U]

[51] Int. Cl.[5] ..... H01R 9/09

[52] U.S. Cl. ..... 439/65; 439/78; 439/108

[58] Field of Search ..... 439/65, 68, 76, 78, 439/79, 108

[56] References Cited

U.S. PATENT DOCUMENTS

| | | | |
|---|---|---|---|
| 4,655,515 | 4/1987 | Hamsher, Jr. et al. | 439/108 |
| 4,871,320 | 10/1989 | Mouissie | 439/78 |
| 5,057,028 | 10/1991 | Lemke et al. | 439/108 |
| 5,098,311 | 3/1992 | Roath et al. | 439/65 |

*Primary Examiner*—Paula A. Bradley
*Attorney, Agent, or Firm*—Kanesaka & Takeuchi

[57] ABSTRACT

A multipole male electrical connector (2) which includes a housing (4) having a fitting cavity (5) opening on a front side thereof; at least one insulation plate (7) extending forwardly into the fitting cavity from a rear wall (8) of the housing; a plurality of terminal receiving channels (9, 10) formed on opposite sides of the insulation plate at a predetermined pitch; at least one terminal plate receiving recess (11) formed on a rear side of the housing; a plurality of terminal apertures (13, 14) formed on the receiving recess so as to communicate with the respective terminal receiving channels on the insulation plate; a plurality of terminals (24, 26) planted on the terminal plate (22) at a predetermined pitch to form a terminal unit (21); the terminal unit being fitted in the receiving recess and secured to the housing by inserting the terminals into the receiving channels through the terminal apertures.

5 Claims, 13 Drawing Sheets

MULTIPOLE ELECTRICAL CONNECTOR

BACKGROUND OF THE INVENTION

1. Field of the Invention

The present invention relates generally to two-piece electrical connectors for connecting two circuit boards and, more particularly, to a two-piece electrical connector having a large number of terminals.

2. Description of the Prior Art

The mounting density of circuit boards increases as the integration density of semiconductor devices increases. For example, the number of terminals of a conventional LSI package has been about 100, but now it is 400 or more. As a result, the number of terminals to be connected across circuit boards is increased to 200 or more.

Components are mounted on a circuit board with the aid of flux and solder. In order to avoid problems with the movement of fluxed contacts, the stand-off of a connector to be mounted has been increased or a chemical treatment has been applied to terminals to prevent the flux from flowing along the terminals. However, since the terminals are press fitted into the housing, there are spaces around the terminals so that the flux can flow along the terminal or the space and deposit on the terminal contact, causing poor contact. Especially, multipole connectors of the press fit type require washing upon soldering in order to prevent any problems with the shift of fluxed contacts, thus presenting an economical problem.

As for connectors having about up to about 100 terminals, it has been proposed to shield the circuit board and the terminal contacts so that no flux flows into them. They have only two rows of terminals, which present little or no problem for integral molding. There are no super multipole connecters which have three or more rows of terminals because of lack of the manufacturing technology.

SUMMARY OF THE INVENTION

Accordingly, it is an object of the invention to provide a multipole electrical connector which is not only easy to manufacture but also precise in the longitudinal dimension of the integral molding.

It is another object of the invention to provide a multipole electrical connector which is free from flux flowing from the terminals and/or their support, thereby eliminating the need for washing before mounting.

According to the invention there is provided a multipole male electrical connector which includes a housing having a fitting cavity opening on a front side thereof; at least one insulation plate extending forwardly into the fitting cavity from a rear wall of the housing; a plurality of terminal receiving channels formed on opposite sides of the insulation plate at a predetermined pitch; at least one terminal plate receiving recess formed on a rear side of the housing; a plurality of terminal apertures formed on the receiving recess so as to communicate with the respective terminal receiving channels on the insulation plate; a plurality of terminals planted on the terminal plate at a predetermined pitch to form a terminal unit; the terminal unit being fitted in the receiving recess and secured to the housing by inserting the terminals into the receiving channels through the terminal apertures.

A number of terminals are planted on the terminal plate to form a terminal unit. It is easy to manufacture super multipole electrical connectors by securing a plurality of such terminal units to the receiving recesses of the housing. The terminal plate separates the dip portions from the contact portions of the terminals without any spaces, thereby preventing the flux from flowing into the contact portions. The terminal plates are fused to the housing, thereby eliminating the need for washing before mounting, resulting in the cost saving. Since a plurality of terminal units are fused to make a whole connector, it is possible to avoid pitch errors that arises when the integral molding is made with all of the terminals at once.

The above and other objects, features, and advantages of the invention will be more apparent from the following description when taken in conjunction with the accompanying drawings.

DESCRIPTION OF THE PREFERRED EMBODIMENT

Figure 1:
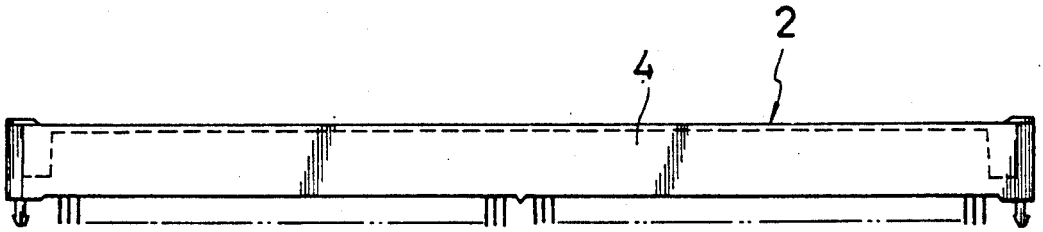
FIG. 1 is a top plan view of a male connector according to an embodiment of the invention.
Figure 2:
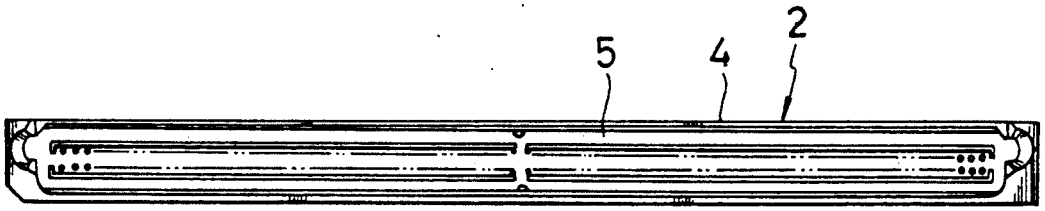
FIG. 2 is a front view of the male connector.
Figure 3:
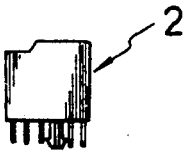
FIG. 3 is a side view of the male connector.
Figure 4:
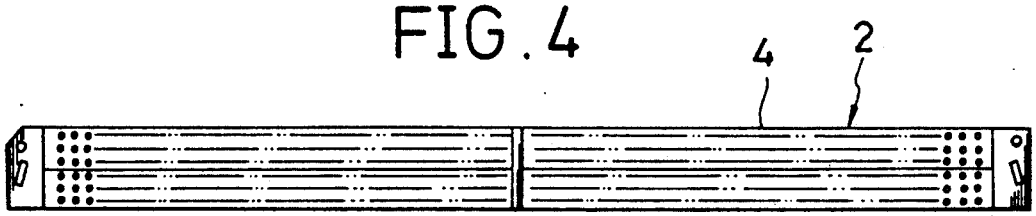
FIG. 4 is a rear view of the male connector.
Figure 5:
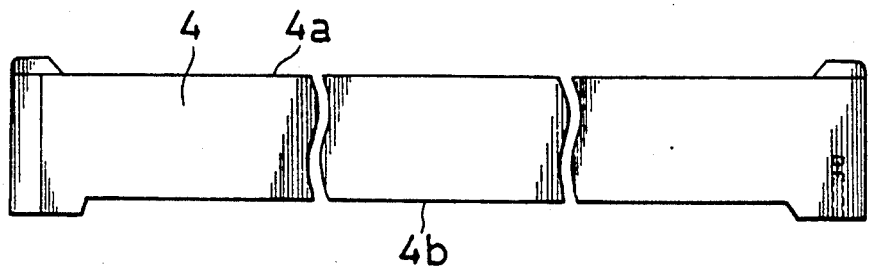
FIG. 5 is a top plan view of a housing of the male connector.
Figure 6:
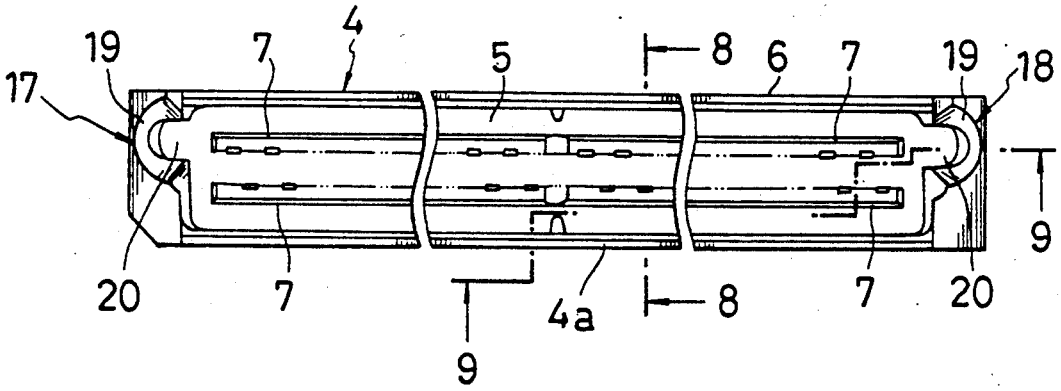
FIG. 6 is a front view of the housing.
Figure 7:
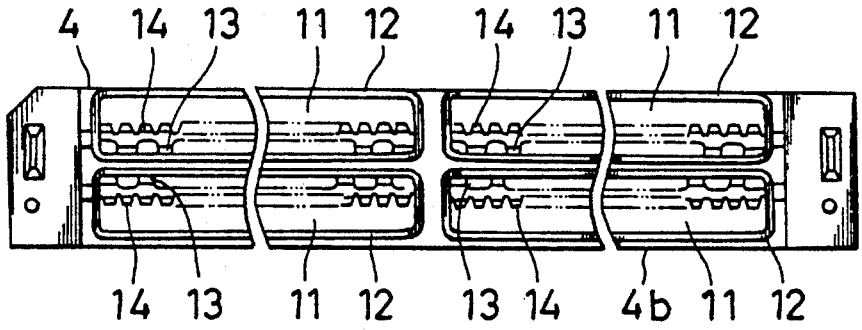
FIG. 7 is a rear view of the housing.
Figure 8:
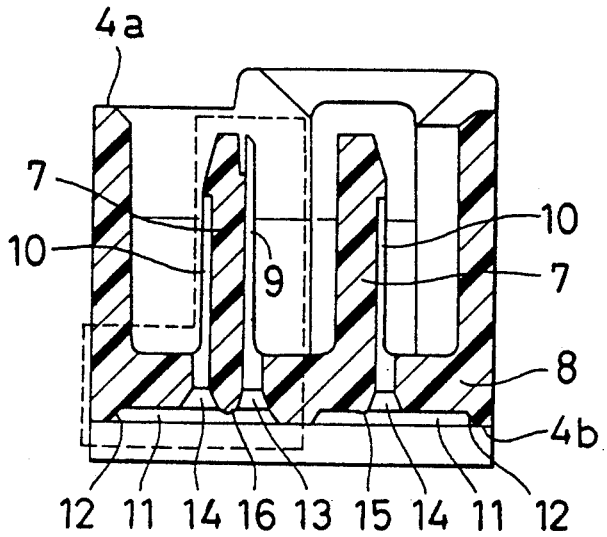
FIG. 8 is a sectional view taken along line 8—8 of FIG. 6.
Figure 9:
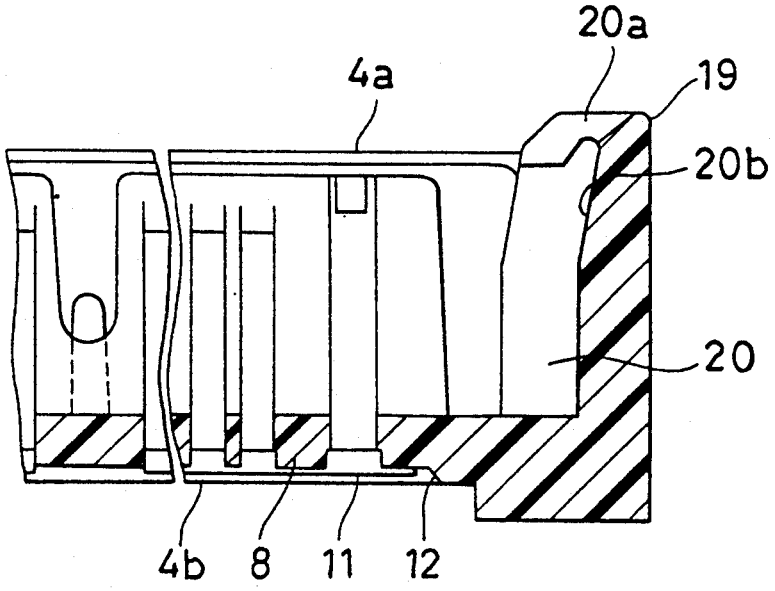
FIG. 9 is a sectional view taken along line 9—9 of FIG. 6.
Figure 10:
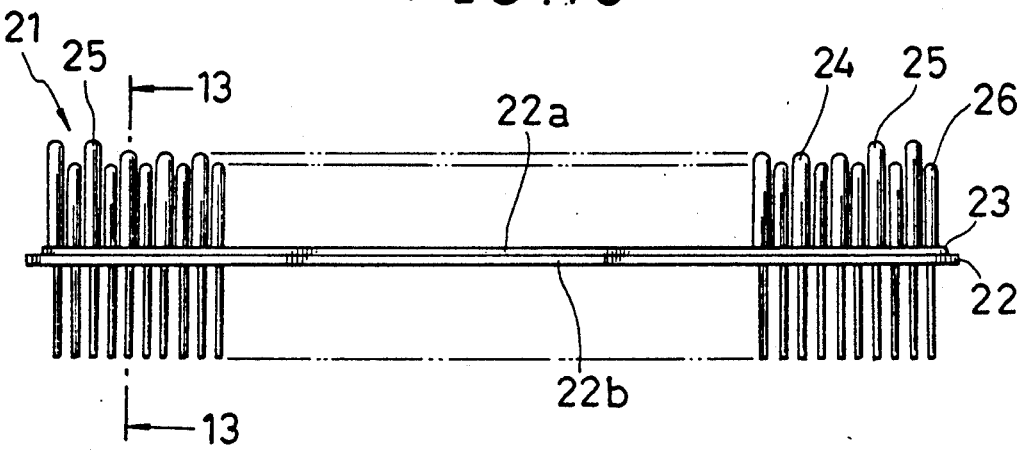
FIG. 10 is a top plan view of a terminal unit according to an embodiment of the invention.
Figure 11:
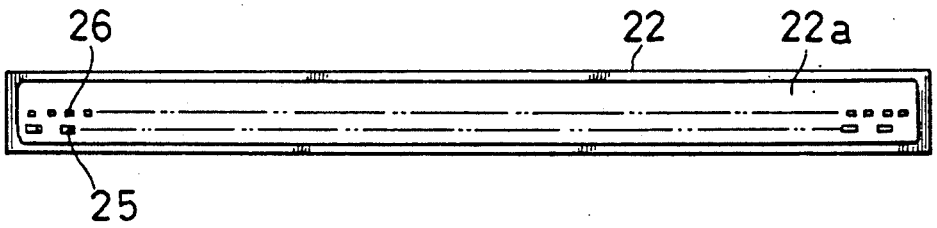
FIG. 11 is a front view of the terminal unit.
Figure 12:
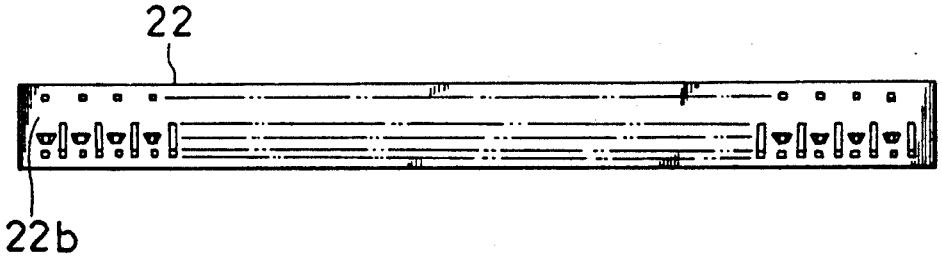
FIG. 12 is a rear view of the terminal unit.
Figure 13:
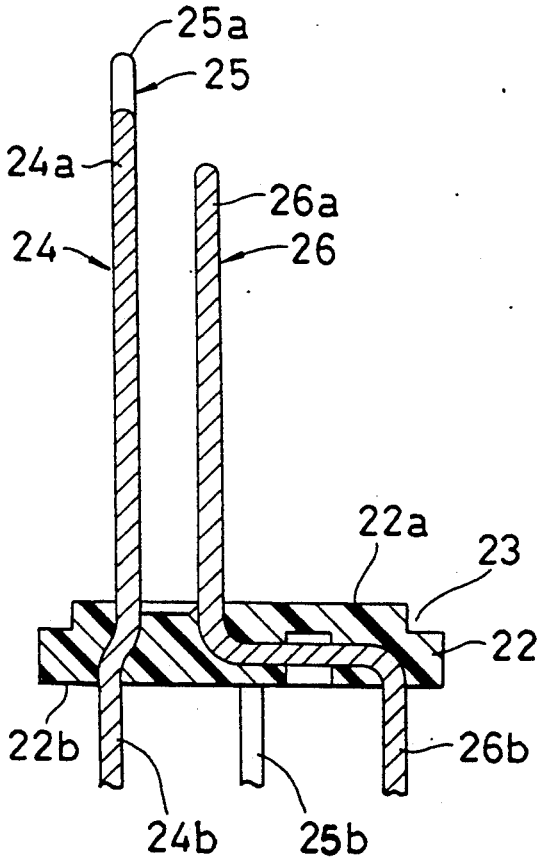
FIG. 13 is a sectional view taken along line 13—13 of FIG. 10.

In FIGS. 1–4, a male connector 2 includes a rectangular housing 4 made from a synthetic resin.

In FIGS. 5-9, the housing 4 has a rectangular fitting cavity 5 on its front side 4a surrounded by a side wall 6. Two pairs of insulation plates 7 extend forwardly from the bottom 8 of the fitting cavity 5. A number of power terminal receiving channels 9 are formed on the inside of the insulation plates 7 at a predetermined pitch while a number of signal terminal receiving channels 10 are formed on the outside of the insulation plates 7 at a half of the predetermined pitch.

Two pairs of rectangular terminal plate receiving recesses 11 are formed on the rear side 4b of the housing 4, thus dividing the rear side 4b into four areas. Each receiving recess 11 has an outwardly sloped wall 12. Terminal apertures 13 and 14 are formed on the receiving recess 11 so as to communicate with the receiving channels 9 and 10, respectively. Ridges 15 and 16 are formed on the receiving recess 11 beneath the insulation plates 7.

A pair of foolproof sections 17 and 18 are formed on opposite sides of the front face 4a for preventing insertion errors. The foolproof section 17 or 18 has a guiding portion 19 raised from the front face 4a such that it has a foolproof recess 20 on the extension line of the upper insulation plates 7. The foolproof recess 20 has an expanded arcking portion 20a and a tapered side wall 20b.

In FIGS. 10-13, a terminal unit 21 includes a rectangular terminal plate 22 which is fitted in the terminal plate receiving recess 11. A stepped-up portion 23 is formed on the front side 22a of the terminal plate 22. A row of power terminals 24 are planted on the terminal plate 22 by integral molding at a predetermined pitch. A pair of the power terminals on opposite sides are used as ground terminals 25. A row of signal terminals 26 are planted on the terminal plate 22 by integral molding at a half of the pitch. Terminal sections 24a, 25a, and 26a and connection sections 24b, 25b, and 26b of the power terminals 24, ground terminals 25, and signal terminals 26 project forwardly from the front side 22a and rearwardly from the back side 22b of the insulation plate 22, respectively. The terminal unit 21 is incorporated into the housing 4.

Figure 14:
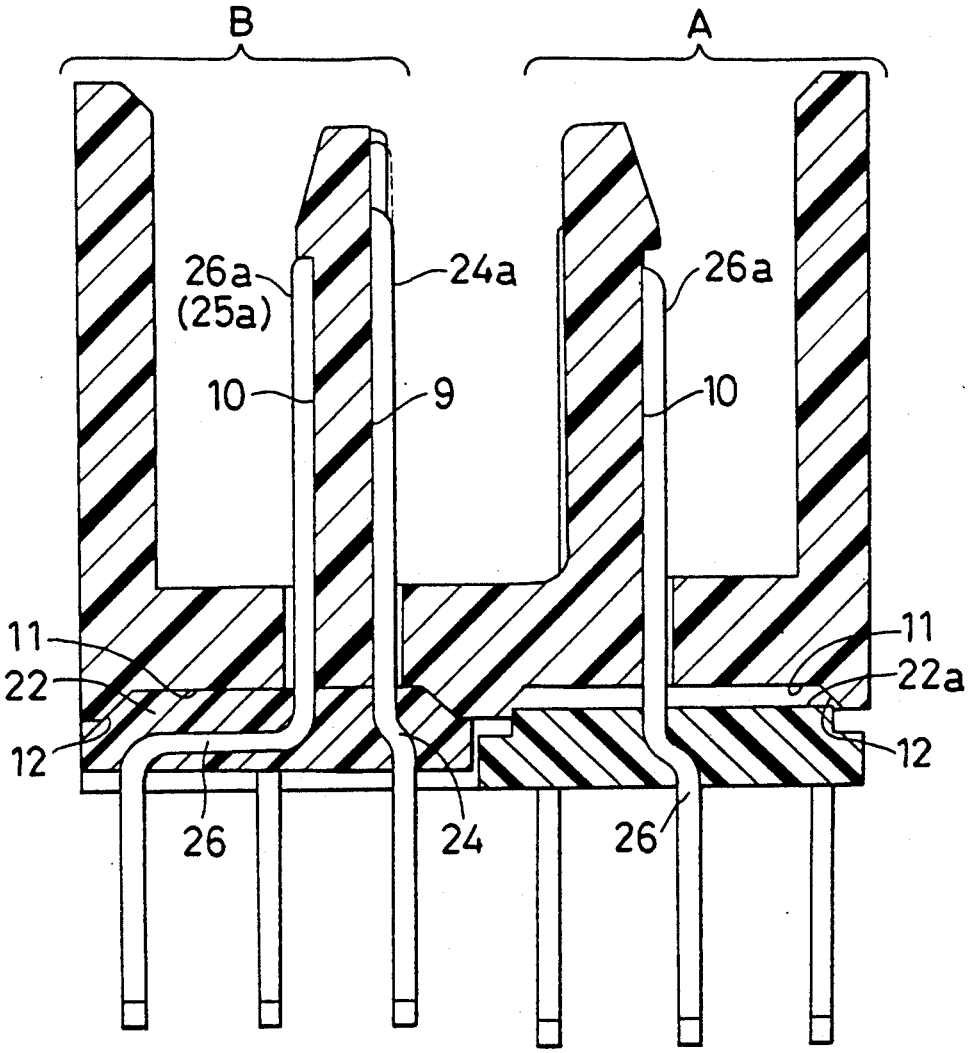
FIG. 14 is a sectional view of the male connector.

In FIG. 14, a terminal unit 21 is placed on each receiving recesses 11 such that the terminal sections 24a, 25a, and 26a of the power terminals 24, ground terminals 25, and signal terminals 26 are put through the terminal apertures 13 and 14 of the housing 4. This condition is illustrated on the right part A, wherein the terminal sections 24a, 25a, and 26a of the power terminals 24, ground terminals 25, and signal terminals 26 are fitted in the receiving channels 9 and 10, respectively, and the front side 22a of the insulation plate 22 is opposed to the receiving recess 11, and the ridges 15 and 16 abut on the front side 22a so that the terminal plate 22 is not fitted in the receiving recess 11.

Then, the terminal plate 22 is fused to the housing 4 by ultrasonic fusion. The periphery of the terminal plate 22 is fused to the sloped side wall 12 while the ridges 15 and 16 are fused to the terminal plate 22 so that the terminal plate 22 is fused to the receiving recess 11 completely. This condition is illustrated in the left part B.

Figure 30:
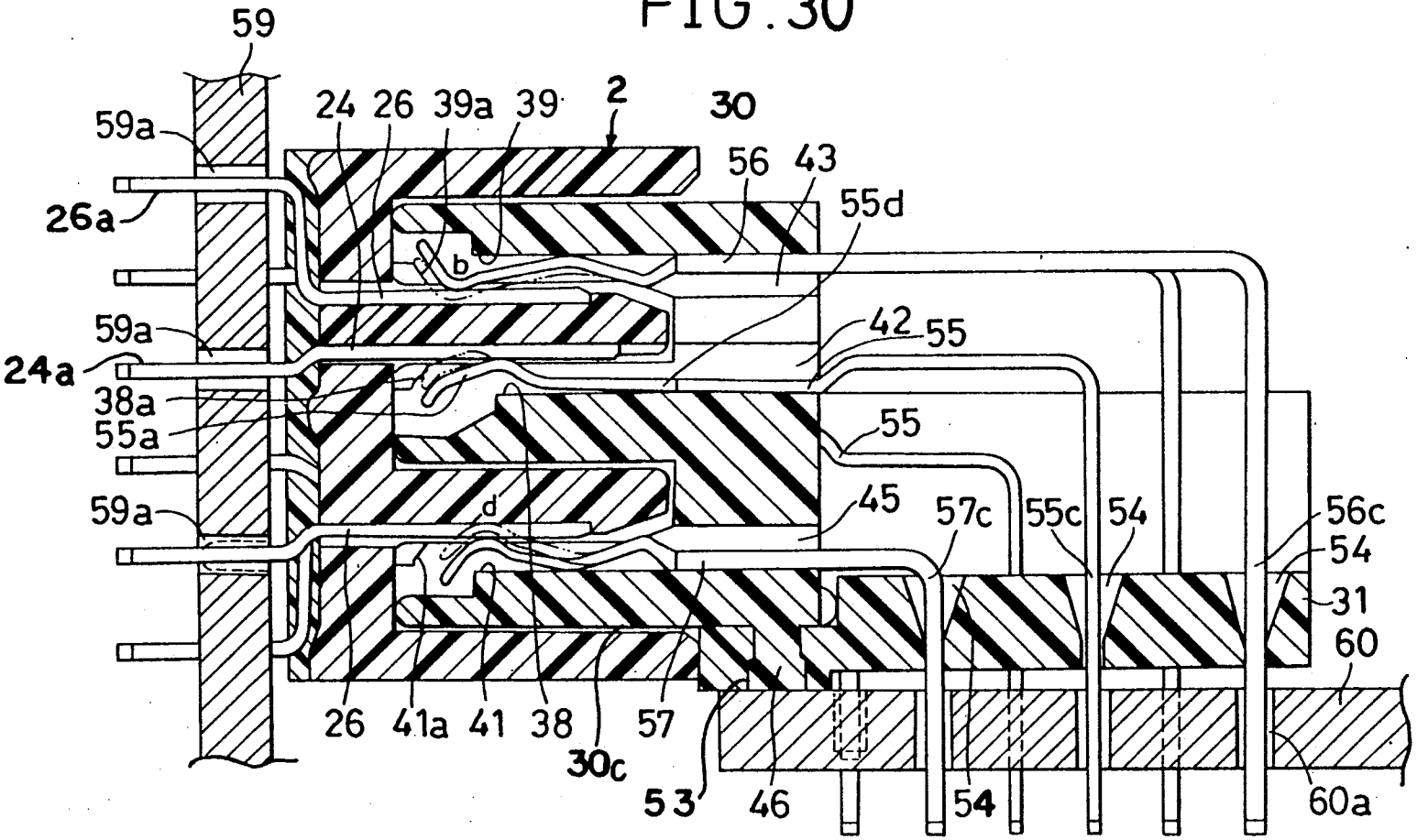
FIG. 30 is a sectional view of the male connector and the female connector under the connected condition.

As FIG. 30 shows, the male connector 2 is mounted on a circuit board 59 by soldiering the legs 24a and 26a of the power terminals 24 and signal terminals 26 to the through holes 59a of the circuit board 59.

Figure 15:
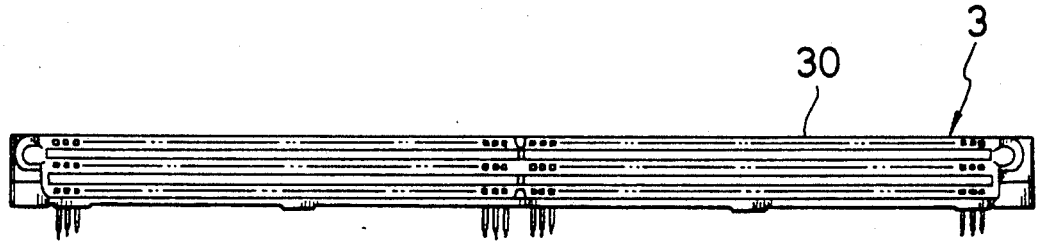
FIG. 15 is a front view of a female connector according to an embodiment of the invention.
Figure 16:
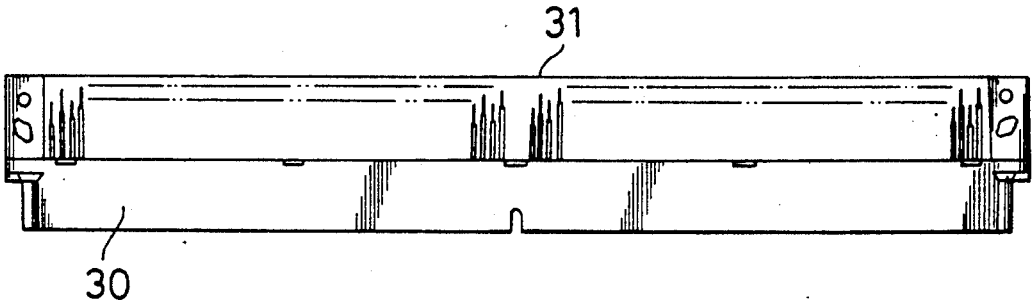
FIG. 16 is a top view of the female connector.
Figure 17:
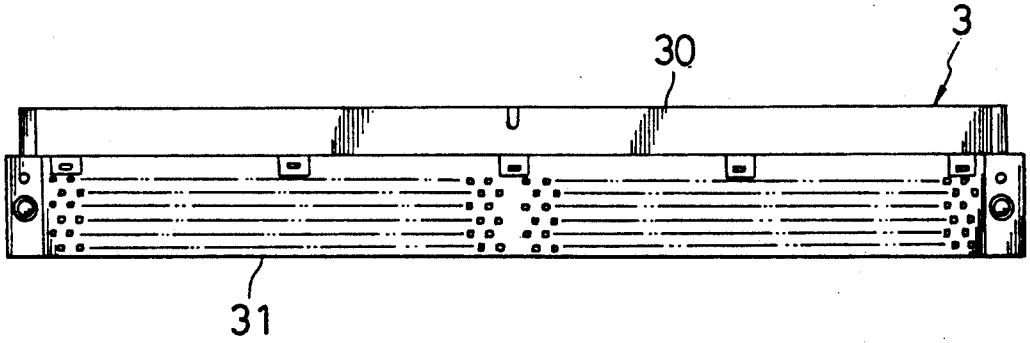
FIG. 17 is a bottom view of the female connector.
Figure 18:
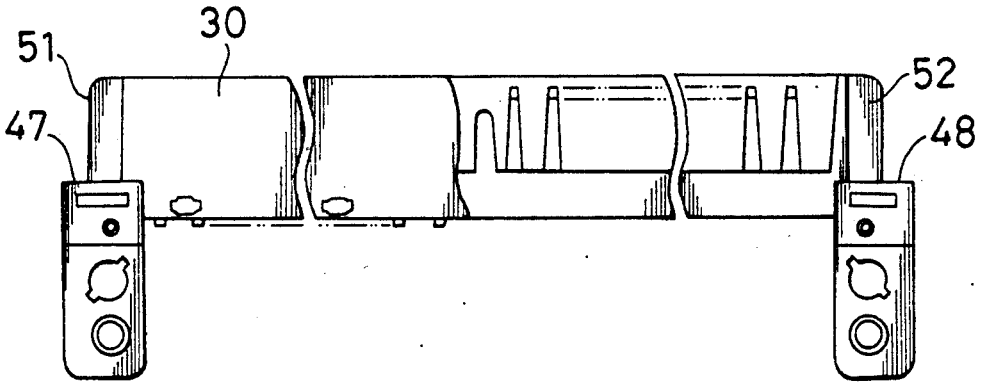
FIG. 18 is a bottom view of a housing of the female connector.
Figure 19:
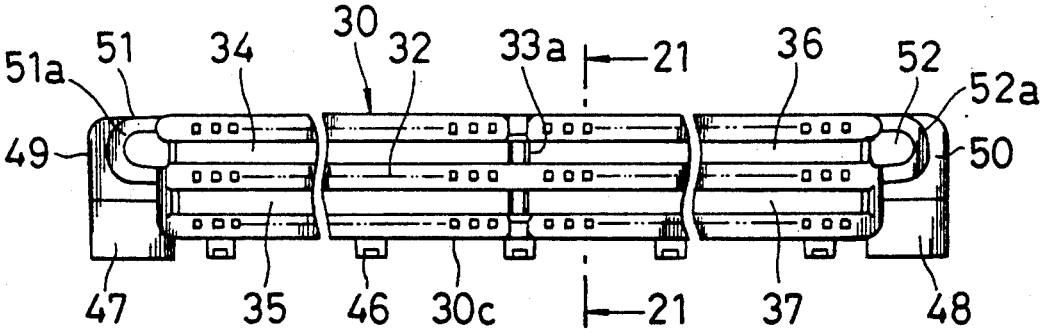
FIG. 19 is a front view of the housing.
Figure 20:
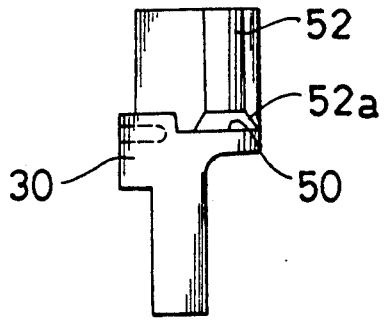
FIG. 20 is a side view of the housing.
Figure 21:
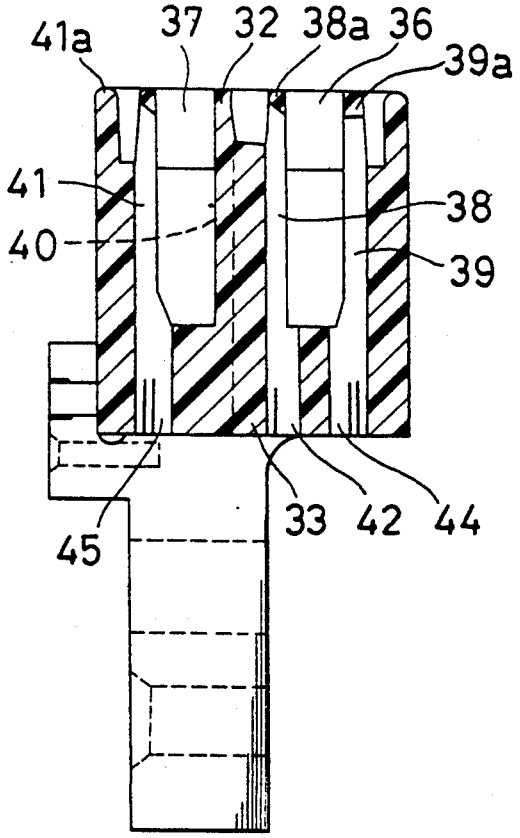
FIG. 21 is a sectional view taken along line 21—21 of FIG. 19.

In FIGS. 15-17, a female connector 3 includes a substantially rectangular housing 30 and a detachable flat locator 31 which is attached to the rectangular housing 30 at right angles.

In FIGS. 18-21, the hollow housing 30 has a central insulation plate 32 extending forwardly from the rear wall 33. A cross rib 33a links the central insulation plate 32 to the housing 30 forming four fitting cavities 34, 35, 36, and 37. A number of power terminal receiving channels 38 are formed on one side of the insulation plate 32 at the predetermined pitch while a number of signal terminal receiving apertures 39 are formed on the upper inside of the housing 30 at a half of the predetermined pitch. Similarly, a number of power terminal receiving channels 40 are formed on the other side of the insulation plate 32 at the predetermined pitch but offset by a half of the pitch with respect to the receiving channels 38. A number of signal terminal receiving channels 41 are formed on the lower inside of the housing at a half of the predetermined pitch. Terminal apertures 42, 43, 44, and 45 are formed on the rear wall 33 of the housing 30 so as to communicate with the respective receiving channels 38, 40, 39, and 41.

A number of engaging studs 46 extend downwardly from the bottom 30c of the housing 30. A pair of abutment mounts 47 and 48 are formed on opposite sides of the housing 30. A pair of guide recesses 49 and 50 are formed on the upper portions of the abutment mounts 47 and 48. A pair of guide projections 51 and 52 extend forwardly from the guide recesses 49 and 50 along opposite sides of the housing 30. The guide recesses 49 and 50 receive the guide portions 19 of the male connector 2 while the guide projections 51 and 52 are inserted into the foolproof recesses 17 and 18.

Figure 22:
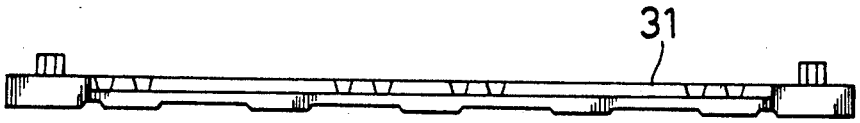
FIG. 22 is a side view of a flat locator of the female connector.
Figure 23:
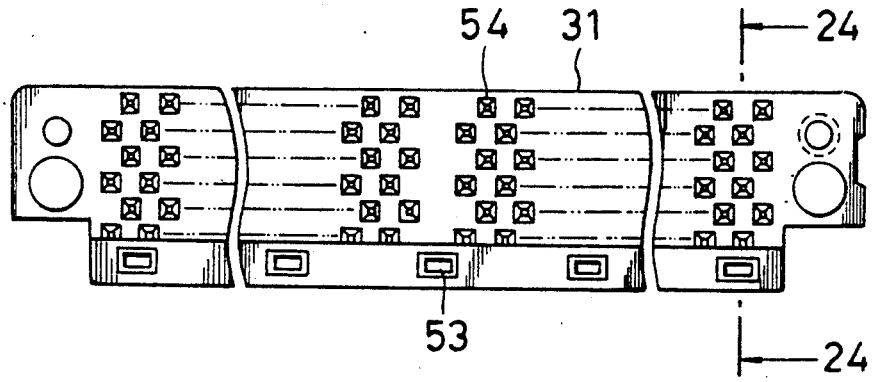
FIG. 23 is a top view of the flat locator.
Figure 24:
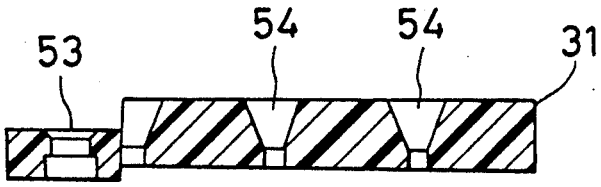
FIG. 24 is a sectional view taken along line 24—24 of FIG. 23.

In FIGS. 22-24, the flat locator 31 has a number of engagement holes 53 on the front stepped-down portion thereof and a number of terminal apertures 54 on the main portion thereof. The flat locator 31 is affixed to the bottom 30c of the housing 30 at right angles by fitting the engagement studs 46 of the housing 30 into the engagement holes 53 thereof (FIG. 30).

Figure 25:
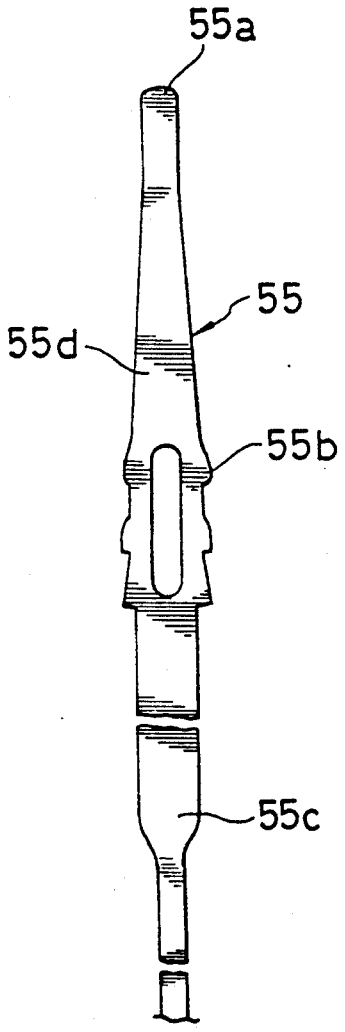
FIG. 25 is a top view of a power terminal according to an embodiment of the invention.
Figure 26:
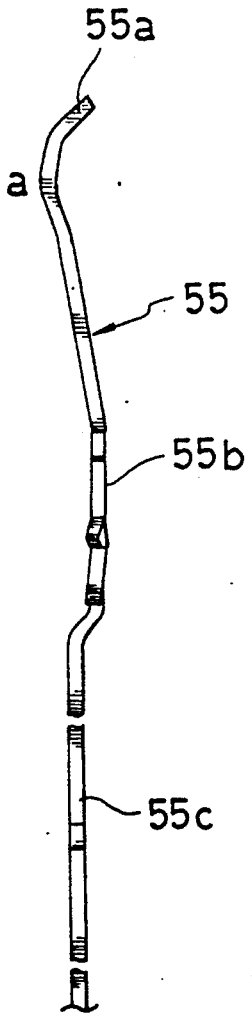
FIG. 26 is a side view of the power terminal.

In FIGS. 25 and 26, a power terminal 55 has a contact portion 55a, a press fit portion 55b, and a leg portion 55c. The section between the press fit portion 55b and the contact portion 55a is curved so as to provide a spring property. The contact portion 55a has a C-shaped cross section and a contact point a on the top.

Figure 27:
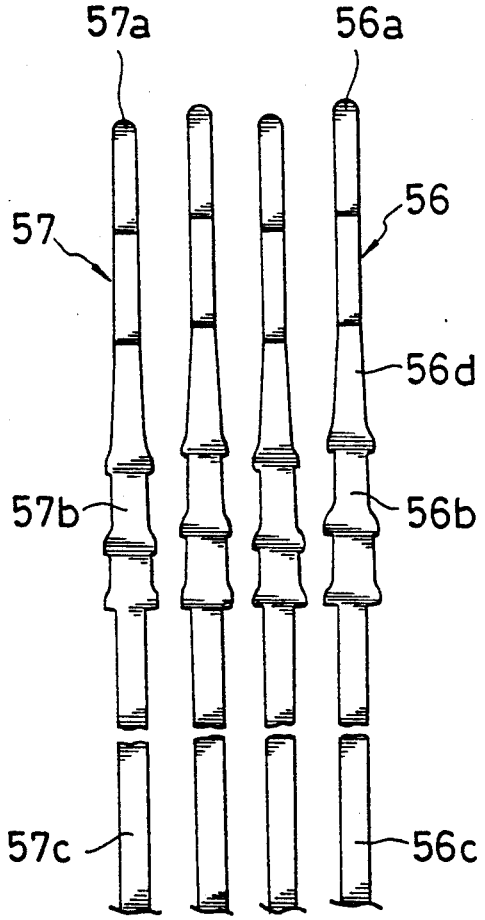
FIG. 27 is a top view of short and tall signal terminals according to an embodiment of the invention.
Figure 28:
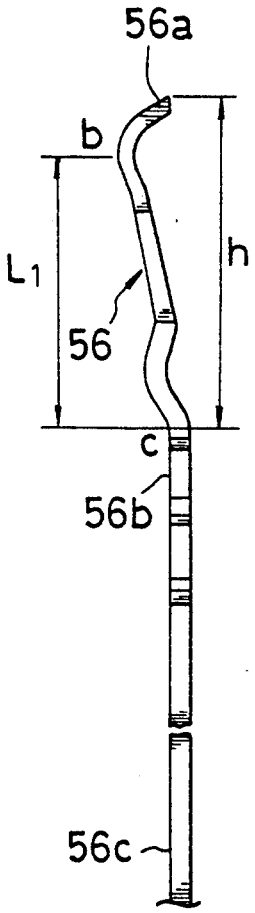
FIG. 28 is a side view of the tall signal terminal.
Figure 29:
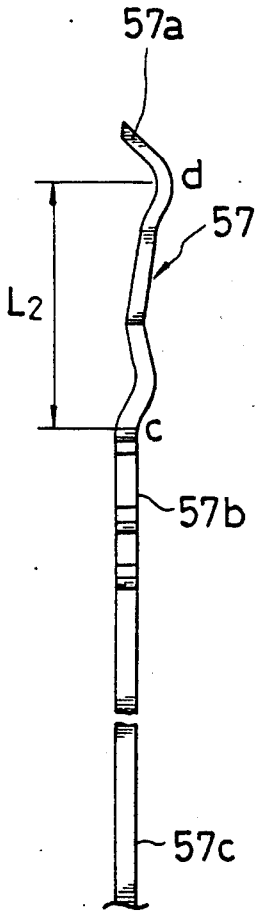
FIG. 29 is a side view of the short signal terminal.

In FIGS. 27-29, there are shown two types of signal terminals. A tall signal terminal 56 has a contact portion 56a, a press fit portion 56b, and a leg portion 56c. The contact portion 56a has a C-shaped cross section and a contact point b on the top. The intermediate section 56d between the contact portion 56a and the press fit portion 56b increases its width toward the press fit portion 56b and has a C-shaped base portion to minimize both the height h of the contact portion 56a and the spring constant.

Similarly, a short signal terminal 57 has a contact portion 57a, a press fit portion 57b, and a leg portion 57c. The contact portion 57a has a C-shaped cross section and a contact point d on the top. The intermediate section 57d between the contact portion 57a and the press fit portion 57b increases its width toward the press fit portion 57b and a C-shaped base portion to minimize both the height h of the contact portion 57a and the spring constant. L2 is made smaller than L1 wherein L1 is the distance between the base point c of the intermediate section 56d and the contact point b and L2 is the distance between the base point c of the intermediate section 57d and the contact point d.

In FIG. 30, the power terminals 55 are put through the terminal apertures 42 of the housing 30 such that the intermediate sections 55*d* and the contact portions 55*a* are fitted in the receiving channels 38, with the end portions of the contact portions 55*a* engaging the hook portions 38*a* of the receiving channels 38. The leg portions 55*c* of the power terminal 55 are bent at right angles in middle portions, and the end portions are inserted in the engage holes 54 of the flat locator 31.

Similarly, the signal terminals 56 and 57 are put through the terminal apertures 43 and 45, respectively, such that the intermediate portions 56*d* and 57*d* and the contact portions 56*a* and 57*a* are fitted in the receiving channels 39 and 41, respectively, with the end portions of the contact portions 56*a* and 57*a* engaging the hook portions 39*a* and 41*a* of the receiving channels 39 and 41, respectively. The leg portions 56*c* and 57*c* of the signal terminals 56 and 57 are bent at right angles in the middle portions, and the end portions are inserted in the engagement apertures 54 of the flat locator 31. Since L1 and L2 are different, the contact points a and b are offset.

The female connector 3 is mounted on a board 60 by soldering the end portions of the leg portions 55*c*, 56*c*, and 57*c* of the power and signal terminals 55, 56, and 57 to the through holes 60*a*. The male and female connector 2 and 3 are connected so that the power terminals 24 and 55, and the signal terminals 26, 56, and 57 of the male and female connectors 2 and 3 are brought into contact with each other for providing electrical continuity between the two circuit boards 59 and 60.

As has been described above, according to the invention, a number of terminals are attached to the terminal plate 22 to form a terminal unit 21. A plurality of such terminal units 21 are fitted into the receiving recesses 11 of the housing 4, and the terminal plate 22 is secured to the housing 4, thereby providing a super multipole connecter without difficulty. The terminal plate 22 separates the contact portions of the terminals from the DIP portions, thereby preventing the flux from flowing from the terminals. The terminal plate 22 fitted in the receiving recess 11 is fused to the housing so that no washing is necessary before mounting on a circuit board.

By selecting the number of terminal units 21 each having the same number of terminals it is possible to prevent the pitch error otherwise arising from the integral molding of the entire terminals at once.

I claim:

1. A multipole electrical connector comprising:

a housing having a fitting cavity opening on a front side thereof;

at least one insulation plate extending forwardly into said fitting cavity from a rear wall of said housing;

a plurality of terminal receiving channels formed on opposite sides of said insulation plate at a predetermined pitch;

at least one terminal plate receiving recess formed on a rear side of said housing and separated from said fitting cavity by said rear wall;

a plurality of terminal apertures formed through said rear wall so as to communicate with said respective terminal receiving channels on said insulation plate;

a terminal plate;

a plurality of terminals planted on said terminal plate at a predetermined pitch to form a terminal unit;

said terminal unit being fitted in said receiving recess and secured to said housing by inserting said terminals into said receiving channels through said terminal apertures.

2. A multipole electrical connector comprising:

a housing having a fitting cavity opening on a front side thereof;

at least one insulation plate extending forwardly into said fitting cavity from a rear wall of said housing;

a plurality of power terminal receiving channels formed on one side of said insulation plate at a predetermined pitch;

a plurality of signal terminal receiving channels formed on the other side of said insulation plate at a half of said predetermined pitch;

at least one terminal plate receiving recess formed on a rear side of said housing;

a plurality of terminal apertures formed on said receiving recess so as to communicate with said respective terminal receiving channels on said insulation plate;

a terminal plate;

a plurality of power terminals and signal terminals planted on said terminal plate at said predetermined pitch and a half of said predetermined pitch, respectively to form a terminal unit; and said terminal unit being fitted in said receiving recess and secured to said housing by placing said power and signal terminals into said respective receiving channels through said terminal apertures.

3. A multipole electrical connector comprising:

a housing having a fitting cavity opening on a front side thereof;

at least one insulation plate extending forwardly into said fitting cavity from a rear wall of said housing;

a plurality of terminal receiving channels formed on opposite sides of said insulation plate at a predetermined pitch;

at least one terminal plate receiving recess formed on a rear side of said housing and separated from said fitting cavity by said rear wall;

a plurality of terminal apertures formed through said rear wall so as to communicate with said respective terminal receiving channels on said insulation plate;

a terminal plate;

a plurality of terminals planted on said terminal plate at a predetermined pitch to form a terminal unit;

said terminal unit being fitted in said receiving recess and secured to said housing by fusing said terminal plate to said receiving recess.

4. The multipole electrical connector of claim 3, wherein said terminal plate is fused to said receiving recess by means of a ultrasonic welding method.

5. The multipole electrical connector of claim 4, wherein said terminals have a terminal leg extending rearwardly from said terminal plate to be soldered to a printed circuit board.

* * * * *